US008598947B2

(12) United States Patent
Kim

(10) Patent No.: US 8,598,947 B2
(45) Date of Patent: Dec. 3, 2013

(54) CONSTANT VOLTAGE OUTPUT GENERATOR WITH PROPORTIONAL FEEDBACK AND CONTROL METHOD OF THE SAME

(75) Inventor: Jong-min Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 116 days.

(21) Appl. No.: 13/085,546

(22) Filed: Apr. 13, 2011

(65) Prior Publication Data

US 2012/0044016 A1 Feb. 23, 2012

(30) Foreign Application Priority Data

Aug. 18, 2010 (KR) ..... 10-2010-0079749

(51) Int. Cl.
*G05F 1/575* (2006.01)

(52) U.S. Cl.
USPC ..... 327/540; 323/271; 323/282

(58) Field of Classification Search
None
See application file for complete search history.

(56) References Cited

U.S. PATENT DOCUMENTS

| | | | | |
|---|---|---|---|---|
| 6,064,187 | A * | 5/2000 | Redl et al. | 323/285 |
| 6,580,258 | B2 * | 6/2003 | Wilcox et al. | 323/282 |
| 6,667,652 | B2 * | 12/2003 | Hosoki | 327/538 |
| 7,402,987 | B2 * | 7/2008 | Lopata | 323/282 |
| 7,554,310 | B2 * | 6/2009 | Chapuis et al. | 323/282 |
| 7,576,527 | B1 * | 8/2009 | Zhang et al. | 323/284 |
| 7,944,282 | B2 * | 5/2011 | Maejima | 327/538 |
| 8,004,263 | B2 * | 8/2011 | Hirata et al. | 323/285 |
| 8,350,617 | B2 * | 1/2013 | Ryu et al. | 327/540 |
| 2008/0290851 | A1 * | 11/2008 | Akashi et al. | 323/283 |

* cited by examiner

*Primary Examiner* — Lincoln Donovan
*Assistant Examiner* — Terry L Englund
(74) *Attorney, Agent, or Firm* — Stanzione & Kim, LLP

(57) ABSTRACT

An electric device and a control method of the same, the electric device including a load terminal, a constant voltage output unit to generate an output voltage to the load terminal, a feedback circuit having a plurality of feedback circuit elements to generate a feedback signal to the constant voltage output unit to adjust the output voltage, and a controller to set a power mode of the electric device and to generate a control signal according to an enable signal and the set power mode such that the control signal corresponds to one or more of the feedback circuit elements to adjust the feedback signal, wherein the enable signal corresponds to a level of the output voltage.

17 Claims, 6 Drawing Sheets

CONSTANT VOLTAGE OUTPUT GENERATOR WITH PROPORTIONAL FEEDBACK AND CONTROL METHOD OF THE SAME

CROSS-REFERENCE TO RELATED APPLICATIONS

This application claims the benefit of priority under 35 U.S.C. §119 to Korean Patent Application No. 10-2010-0079749, filed on Aug. 18, 2010 in the Korean Intellectual Property Office, the disclosure of which is incorporated herein by reference in its entirety.

BACKGROUND OF THE INVENTION

1. Field of the Invention

Apparatuses and methods consistent with the exemplary embodiments relate to an electric device and a control method of the same, and more particularly, to an electric device and a control method of the same which receives power from an auxiliary power source such as a battery.

2. Description of the Related Art

Electric devices may be operated by using several different power modes in order to save on power consumption. Typically, the power modes include a normal mode, a screen save mode, an idle mode and an automatic off mode.

One of the critical issues in a portable mobile electric device is a stable power supply while being transported. If the mobile electric device receives power from a battery, power consumption may be reduced by decreasing a voltage output from a constant voltage output unit, such as a DC/DC converter, compared to a rated voltage when receiving power from an adaptor may be used to secure a battery life. That is, a power save mode which reduces a voltage margin of a load terminal to increase the battery life is used. If power required for the load terminal drastically changes or the load terminal is overloaded consistently, there is a possibility that a sufficient voltage is not applied to the load terminal, and a system of the electric device may have an error.

SUMMARY OF THE INVENTION

Aspects and utilities of the present general inventive concept will be set forth in part in the description which follows and, in part, will be obvious from the description, or may be learned by practice of the present general inventive concept.

The present general inventive concept provides an electric device and a control method of the same which supplies stable power corresponding to a drastic change in a load terminal.

The present general inventive concept provides an electric device and a control method of the same which prevents a system error due to a drastic change in a load terminal.

Features and/or utilities of the present general inventive concept can be realized by an electric device including a constant voltage output unit including a feedback terminal to receive a feedback voltage and an output terminal to output an output voltage generated on the basis of the received feedback voltage and a predetermined reference voltage. The electric device further includes a feedback circuit connected between the output terminal and the feedback terminal and to adjust the feedback voltage applied to the feedback terminal, a load terminal to receive power from the constant voltage output unit, a detector to output an enable signal when a voltage level of a power input terminal of the load terminal is a predetermined critical value or less, and a controller to receive the outputted enable signal and to control the feedback circuit to adjust the feedback voltage, wherein when the controller receives the outputted enable signal, the controller controls the feedback circuit to adjust the feedback voltage to cause the constant voltage output unit to output a rated voltage from the output terminal.

The predetermined critical value may be lower than a lowest level of the output voltage.

The feedback circuit may include a first resistor connected between the output terminal and the feedback terminal, a plurality of branch resistors connected in parallel between a first node provided between the first resistor and the feedback terminal, and a ground terminal, and at least one switch connected in series to the branch resistors between the branch resistors and the ground terminal. The controller may include a microcomputer to output a first control signal to control the feedback circuit to adjust the feedback voltage to cause the constant voltage output unit to output a rated voltage from the output terminal, and an OR circuit to receive one of the first control signal and the enable signal, and when one of the first control signal and the enable signal is received, to output a signal to one of the switches to turn on the respective switch.

The feedback circuit may include a first resistor connected between the output terminal and the feedback terminal, a plurality of branch resistors connected in series between a first node provided between the first resistor and the feedback terminal, and a ground terminal, and a switch individually connected between at least one node of the plurality of branch resistors and the ground terminal. The controller may include a microcomputer to output a first control signal to control the feedback circuit to adjust the feedback voltage to cause the constant voltage output unit to output a rated voltage from the output terminal, and an OR circuit to receive one of the first control signal and the enable signal and when one of the first control signal and the enable signal is received, to output a signal to the switch to turn on the switch.

The electric device may further include an adaptor and a battery which supply source power to the constant voltage output unit, and the load terminal may be driven by one of an adaptor mode in which the adaptor supplies the source power, and a battery mode in which the battery supplies the source power, and the controller may control the feedback circuit to adjust the feedback voltage to cause the constant voltage output unit to decrease the output voltage to be lower than the rated voltage if the load terminal is driven in the battery mode.

Features and/or utilities of the present general inventive concept may also be realized by a control method of an electric device which includes a constant voltage output unit including a feedback terminal to receive a feedback voltage and an output terminal to output an output voltage generated on the basis of the received feedback voltage and a predetermined reference voltage, and a load terminal to receive power from the constant voltage output unit, the control method including adjusting the feedback voltage applied to the feedback terminal on the basis of a control signal, detecting a voltage level of a power input terminal of the load terminal and determining whether the detected voltage level is a predetermined critical value or less, outputting an enable signal if it is determined that the detected voltage level is the critical value or less, and adjusting the feedback voltage to cause the constant voltage output unit to output a rated voltage from the output terminal according to the enable signal.

The predetermined critical value may be lower than a lowest level of the output voltage.

The electric device may include a first resistor connected between the output terminal and the feedback terminal, a plurality of branch resistors connected in parallel between a first node provided between the first resistor and the feedback terminal, and a ground terminal, a feedback circuit which includes at least one switch connected in series to the branch resistors between branch resistors and the ground terminal, and the control method may further include outputting the enable signal to one of the switches that is turned on by a first control signal to cause the constant voltage output unit to output the rated voltage from the output terminal.

The electric device may include a first resistor connected between the output terminal and the feedback terminal, a plurality of branch resistors connected in series between a first node provided between the first resistor and the feedback terminal, and a ground terminal, a feedback circuit which includes a switch individually connected between at least one node of the branch resistors and the ground terminal, and the control method may further include outputting the enable signal to one of the switches that is turned on by a first control signal to cause the constant voltage output unit to output the rated voltage from the output terminal.

The electric device may further include an adaptor and a battery to supply source power to the constant voltage output unit, and the control method may further include determining whether the source power is supplied by which one of the adaptor and the battery, and adjusting the feedback voltage to cause the constant voltage output unit to output a level of voltage lower than the rated voltage if it is determined that the source power is supplied by the battery.

Features and/or utilities of the present general inventive concept may also be realized by an electric device including a load terminal, a constant voltage output unit to generate an output voltage to the load terminal, a feedback circuit having a plurality of feedback circuit elements to generate a feedback signal to the constant voltage output unit to adjust the output voltage, and a controller to set a power mode of the electric device and to generate a control signal according to an enable signal and the set power mode such that the control signal corresponds to one or more of the feedback circuit elements to adjust the feedback signal, wherein the enable signal corresponds to a level of the output voltage.

The control signal may include a plurality of sub-control signals to correspond to the respective feedback circuit elements and the controller may selectively output one or more of the plurality of sub-control signals according to the set power mode and the enable signal.

The electric device may include a detector to detect the output voltage and to generate the enable signal if the level of the output voltage is equal to or less than a predetermined critical level.

If the set power mode is a low power mode and the enable signal is off, the control signal may interact with at least one of the feedback circuit elements to adjust the feedback signal to adjust the output voltage to a level lower than a rated voltage, and if the set power mode is the low power mode and the enable signal is on, the control signal may interact with at least one of the feedback circuit elements to adjust the feedback signal to adjust the output voltage to the rated voltage.

The feedback circuit may generate the feedback signal as a proportion of the output voltage according to the control signal and the constant voltage output unit generates the output voltage according to the proportion. The constant voltage output unit may increase the output voltage when the proportion of the feedback signal and the output voltage increases and may decrease the output voltage when the proportion of the feedback signal and the output voltage decreases.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
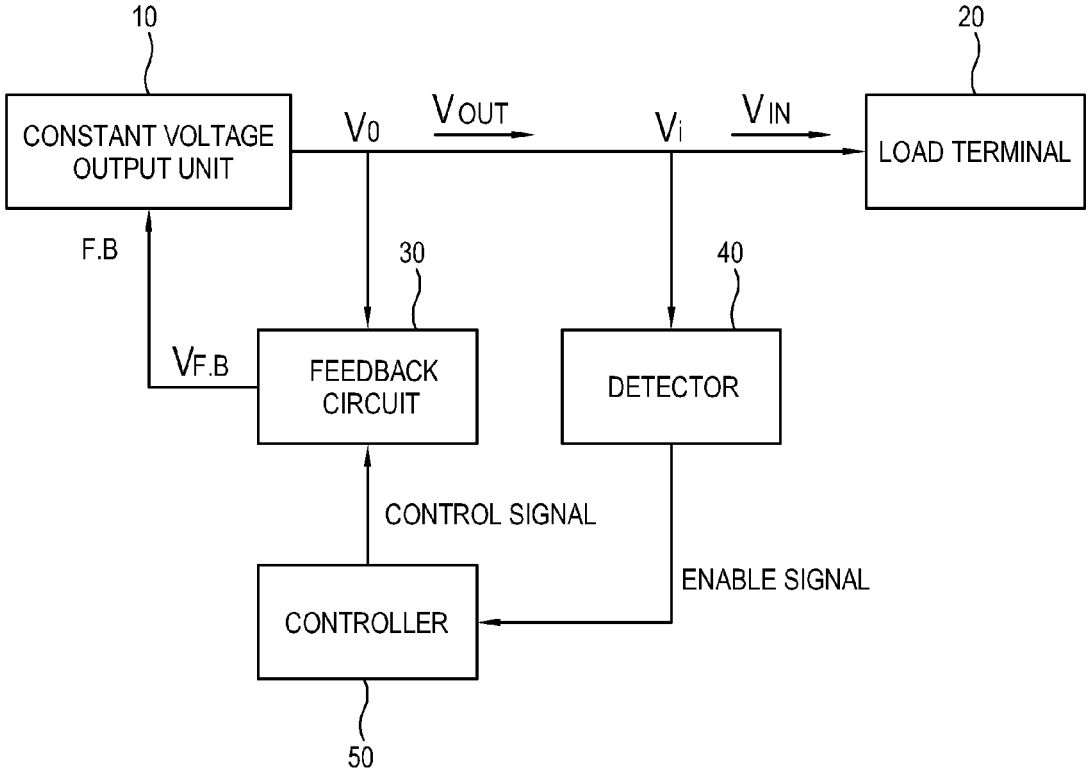
FIG. 1 is a control block diagram of an electric device according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a control block diagram of an electric device according to an exemplary embodiment of the present general inventive concept.

As shown therein, the electric device includes a constant voltage output unit 10, a load terminal 20, a feedback circuit 30, a detector 40 and a controller 50 which controls the foregoing elements. The electric device according to the present exemplary embodiment may be included in a mobile terminal such as a notebook computer, a netbook, a portable multimedia player (PMP), a mobile phone, or a TV including a display unit, or a monitor. The electric device may receive power from an adaptor as a main power source or may receive sub power from a battery, such as a rechargeable secondary battery. If a user uses the electric device while moving, he/she mainly uses sub power. If the battery is used, securing the maximum battery life and reducing power consumption for securing the battery life emerge as major issues.

The constant voltage output unit 10 generates a predetermined output voltage $V_{OUT}$ from primitive power supplied by a power supply such as an adaptor or a battery and outputs the output voltage $V_{OUT}$ to the load terminal 20. The constant voltage output unit 10 receives a feedback voltage $V_{F.B}$ at a feedback terminal F.B and outputs the output voltage $V_{OUT}$ at output terminal $V_O$. The level of the output voltage $V_{OUT}$ is determined on the basis of a preset reference voltage (not shown) and the feedback voltage $V_{F.B}$. The constant voltage output unit 10 may include a DC/DC converter and may convert primitive power into an output voltage $V_{OUT}$. The constant voltage output unit 10 may generate an output voltage $V_{OUT}$ at various levels depending on a capacity of the load terminal 20 or a power mode. If power is supplied by the battery, the electric device may be set to a low power mode and set the level of the output voltage $V_{OUT}$ to be lower than a rated voltage of the constant voltage output unit 10. If the battery is used, the load terminal 20 may be driven by a voltage lower than a typical rated voltage to extend the life of the battery.

The load terminal 20 includes a circuit unit such as a chipset, and performs various functions by receiving power from the constant voltage output unit 10.

The feedback circuit 30 is connected between an output terminal $V_0$ and the feedback terminal F.B of the constant voltage output unit 10, and adjusts the feedback voltage $V_{F.B}$ applied to the feedback terminal F.B to different levels. The feedback circuit 30 may generate the feedback voltage $V_{F.B}$ as a proportion of the output voltage $V_{OUT}$. Since a level of the output voltage $V_{OUT}$ is determined on the basis of a preset reference voltage (not shown) and the feedback voltage $V_{F.B}$, if the level of the feedback voltage $V_{F.B}$ is changed, the load terminal 20 also receives power at a changed level. The constant voltage output unit 10 may increase the output voltage $V_{OUT}$ when the proportion of the feedback voltage $V_{F.B}$ and the output voltage $V_{OUT}$ is increased and may decrease the output voltage $V_{OUT}$ when the proportion of the feedback voltage $V_{F.B}$ and the output voltage $V_{OUT}$ is decreased. The feedback circuit 30 also may receive a control signal from the controller 50. The feedback circuit 30 will be further described later.

The detector 40 detects a level of an input voltage $V_{IN}$ input from a power input terminal $V_i$ of the load terminal 20, and outputs an enable signal if the detected level of the input voltage $V_{IN}$ is a predetermined critical value or less. The critical value may be set to be lower than a lowest level of the output voltage $V_{OUT}$. If power required for the load terminal 20 drastically changes or the load terminal 20 is overloaded continuously, the system of the electric device may have an error due to a drop of the input voltage $V_{IN}$ of the load terminal 20. The detector 40 detects such a voltage drop, and notifies the controller 50 of the voltage drop by, for example, an enable signal, if the input voltage $V_{IN}$ drops below the critical value.

The controller 50 outputs a control signal to control the feedback circuit 30 to adjust the feedback voltage $V_{F.B}$ applied to the feedback terminal F.B of the constant voltage output unit 10 to different levels. The controller 50 may output the control signal according to an enable signal received from the detector 40. The controller 50 may also include a microcomputer to change a power mode of the electric device according to a predetermined condition.

The electric device may operate according to various power modes such as a normal mode in which a rated voltage is output, and low power modes, such as a screen save mode in which power supplied to a display unit is cut off if the electric device includes the display unit, a power saving mode in which a level of power supplied to a backlight unit is decreased if the electric device includes the backlight unit, and a sleep mode in which lowest power is supplied. The controller 50 outputs to the feedback circuit 30 different control signals according to the foregoing power modes. The control signal may be received from the outside or generated by the controller 50.

The controller 50 controls the input voltage $V_{IN}$ supplied to the load terminal 20 to be a rated voltage upon receiving an enable signal from the detector 40. That is, the controller 50 controls the feedback circuit 30 to adjust the feedback voltage $V_{F.B}$ to cause the constant voltage output unit 10 to supply the rated voltage to prevent a system error which may occur when the load terminal 20 is driven by a voltage lower than a required voltage. The controller 50 according to the present exemplary embodiment controls the feedback circuit 30 to adjust the feedback voltage $V_{F.B}$ to cause the constant voltage output unit 10 to output the rated voltage corresponding to the enable signal, but not limited thereto. For example, the controller 50 may control the feedback circuit 30 to adjust the feedback voltage $V_{F.B}$ to cause the constant voltage output unit 10 to output to the load terminal 20 a voltage at a lower level than the rated voltage as long as such voltage has a level that enables a power supply required for the load terminal 20. In the case that a low power mode is set and the constant voltage output unit 10 is generating an output voltage at a lower level than the rated voltage and the detector 40 detect a drop in the output voltage $V_{OUT}$ to below a critical predetermined level, the detector 40 may generate an enable signal, causing the controller 50 to control the feedback circuit 30 to adjust the feedback voltage $V_{F.B}$ such that the constant voltage output unit 10 adjusts the output voltage $V_{OUT}$ to a rated voltage.

Figure 2:
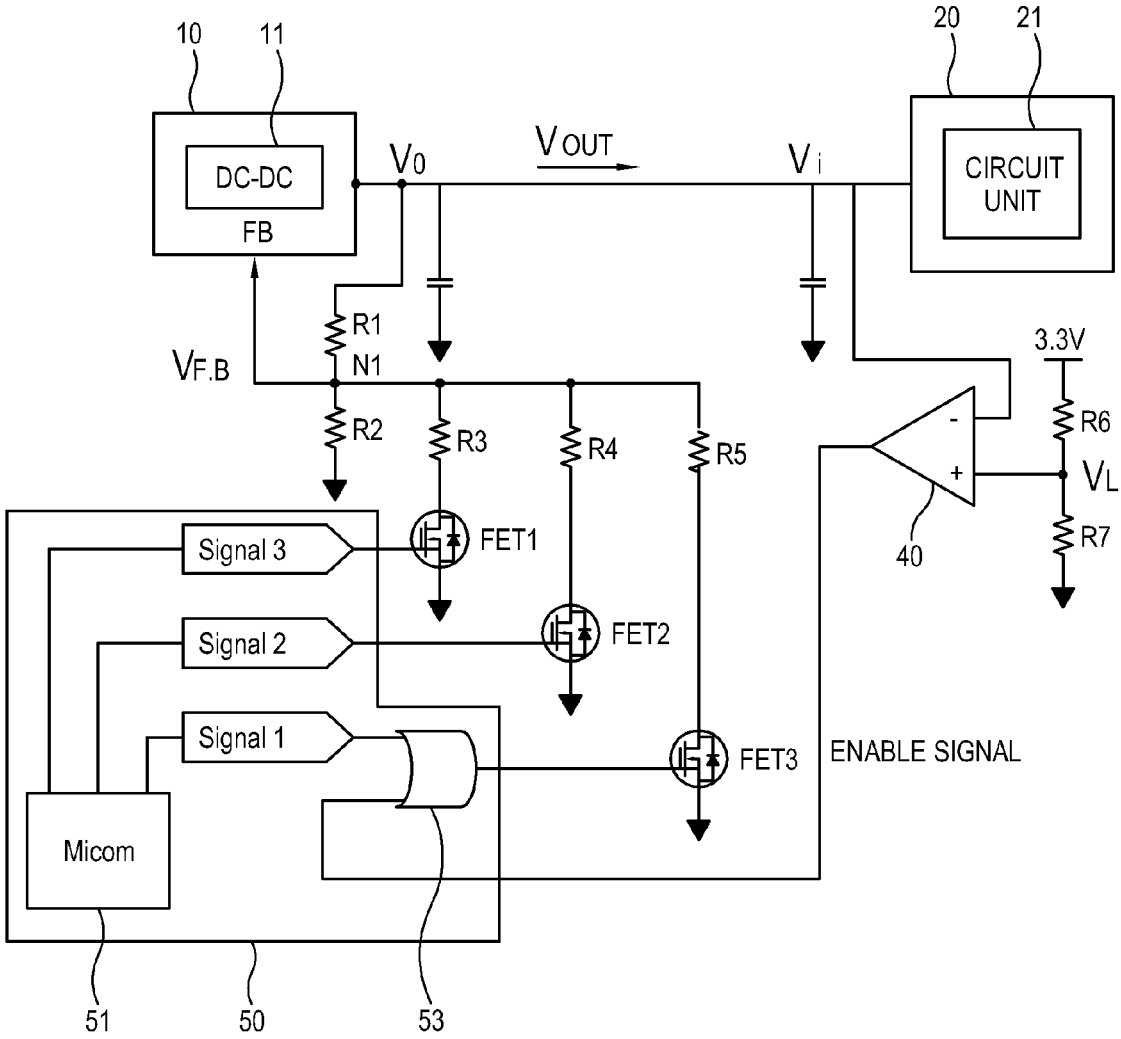
FIG. 2 is a feedback circuit diagram of the electric device according to an exemplary embodiment of the present general inventive concept.

FIG. 2 is a feedback circuit diagram of the electric device according to the present exemplary embodiment. As shown therein, the constant voltage output unit 10 includes a DC/DC converter 11, and the load terminal 20 includes a circuit unit 21. The feedback circuit 30 includes a plurality of resistors R1 to R5 and switches FET1 to FET3. The detector 40 includes a comparator, and the controller 50 includes a microcomputer 51 and an OR circuit 53.

The feedback circuit 30 includes a first resistor R1 connected between the output terminal $V_O$ and the feedback terminal F.B, and a plurality of branch resistors R2, R3, R4 and R5 connected in parallel between a first node N1 provided between the first resistor R1 and the feedback terminal F.B, and a ground terminal. The feedback circuit 30 includes switches FET1, FET2 and FET3 which are connected in series to the branch resistors R3, R4 and R5 between some of the plurality of branch resistors R2, R3, R4 and R5 and the ground terminal. The feedback circuit 30 according to the present exemplary embodiment includes four branch resistors R2, R3, R4 and R5 and three switches FET1, FET2 and FET3, but is not limited thereto. Alternatively, the feedback circuit 30 may include a smaller number or a larger number of branch resistors and switches depending on the type of the power mode. By changing a combination of the first resistor R1 and the branch resistors R2 to R5 according to a turning on or a turning off of the switches FET1, FET2 and FET3, a voltage applied to the first node N1 is changed and the output voltage $V_{OUT}$ is adjusted accordingly. According to the present exemplary embodiment, voltages of the feedback terminal F.B and the first node N1 are the same, but an additional resistor may be provided between the feedback terminal F.B and the first node N1. A stabilizing capacitor is connected between the output terminal $V_O$ and the ground terminal.

The comparator 40 detects the input voltage $V_{IN}$ of the load terminal 20. If the input voltage $V_{IN}$ is lower than a predetermined critical voltage $V_L$, i.e., low compared to the critical value, the comparator 40 informs the controller 50 of the foregoing. The critical voltage $V_L$ is determined by a predetermined power source, a sixth resistor R6 and a seventh resistor R7. The critical voltage $V_L$ according to the present exemplary embodiment is set as a level lower than the output voltage $V_{OUT}$ having the lowest level which may be output by the output terminal $V_O$. An output signal which is output by the comparator 40 acts as an enable signal.

The microcomputer 51 may output at least one of plurality of sub-control signals, SIGNAL 1, SIGNAL 2, and SIGNAL 3, as the control signal, each sub-control signal corresponding to one of switches FET1, FET2, and FET3 to turn on or off the switches FET1, FET2 and FET3. The plurality of switches FET1, FET2 and FET3 may all be turned off or on. Also, at least one of the plurality of switches FET1, FET2 and FET3 may be turned on. According to the present exemplary embodiment, only the third switch FET3 is turned on by a first control signal, and the output voltage $V_{OUT}$ becomes a rated voltage when a feedback voltage $V_{F.B}$ is generated by a combination of the first resistor R1, the second resistor R2 and the fifth resistor R5.

The OR circuit 53 receives one of the first control signal controlling the rated voltage to be output, and the enable signal, and outputs the signal to the switch that is turned on by the first control signal, i.e., to a control terminal of the third switch FET3. That is, the OR circuit 53 is connected between the microcomputer 51 and the third switch FET3 that is turned on by the first control signal, and turns on the third switch FET3 according to one of the first control signal and the enable signal.

In the electric device, only the OR circuit 53 and the comparator 40 are added in a front end of the switch FET3 to an existing circuit to thereby detect a voltage drop of the load terminal 20 and automatically cause a rated voltage to be supplied to the load terminal 20 in a predetermined case.

Figure 3:
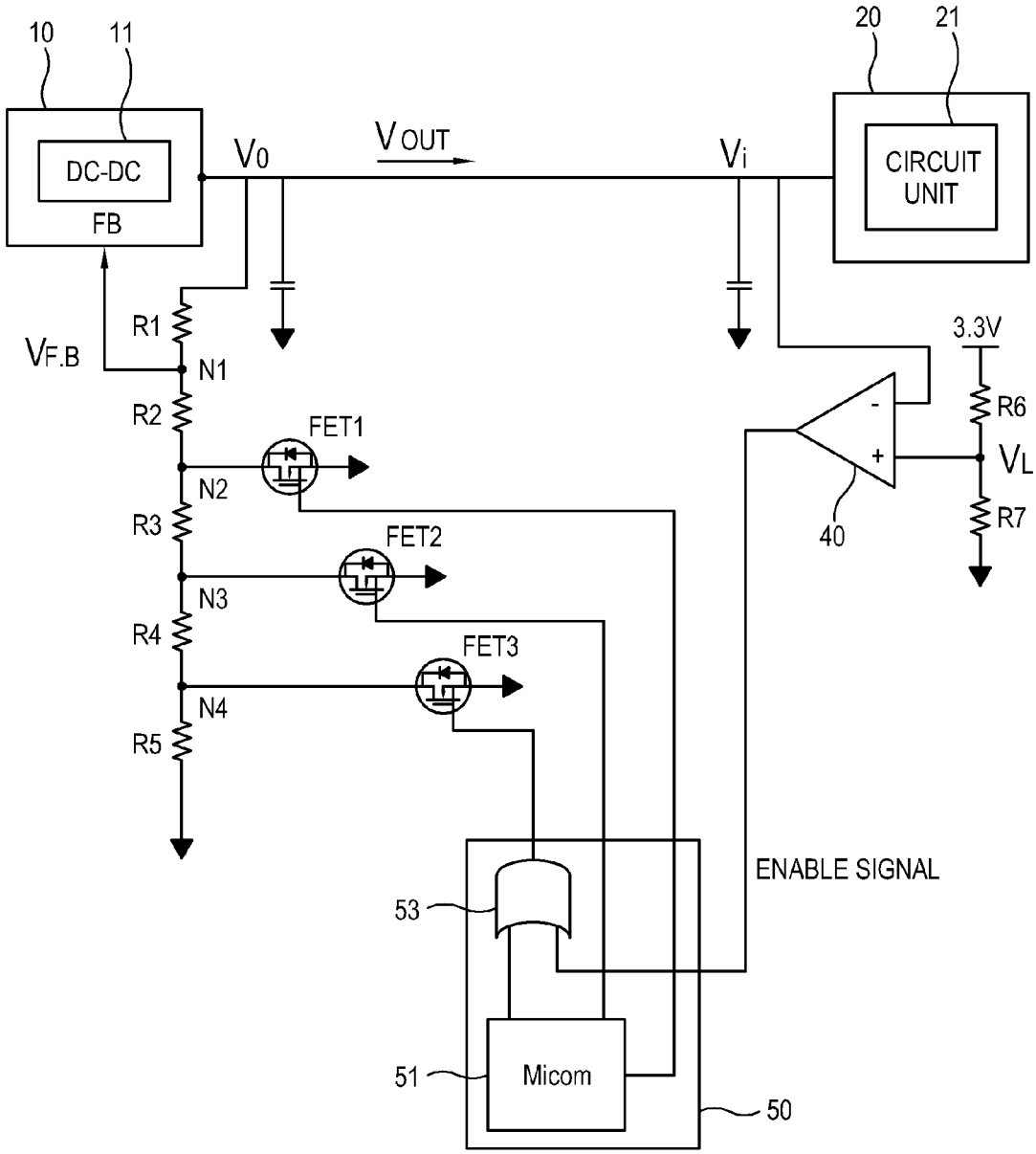
FIG. 3 is another feedback circuit diagram of the electric device according to an exemplary embodiment of the present general inventive concept.

FIG. 3 is a feedback circuit diagram of an electric device according to another exemplary embodiment of the present invention.

As shown therein, the feedback circuit 30 includes a first resistor R1 and branch resistors R2, R3, R4 and R5 connected in series rather than in parallel. That is, the feedback circuit 30 includes the first resistor R1 connected between the output terminal $V_O$ and the feedback terminal F.B, and the plurality of branch resistors R2, R3, R4 and R5 connected in series between the first node N1 and the ground terminal. The switches FET1, FET2 and FET3 are connected individually between at least one of nodes N2, N3 and N4 provided between the plurality of branch resistors R2, R3, R4 and R5, and the ground terminal.

The switches FET1, FET2 and FET3 connect one of the branch resistors R2, R3, R4 and R5 to the ground terminal according to a control signal like in the foregoing exemplary embodiment. According to which switches of FET1, FET2 and FET3 are turned on, the branch resistors R2, R3, R4 and R5 which are connected in series under the first resistor R1 are changed, and the feedback voltage $V_{F.B}$ is changed accordingly.

If the third switch FET3 is turned on by a first control signal or an enable signal, the feedback voltage $V_{F.B}$ is determined by the first resistor R1 and the second to fourth branch resistors R2, R3 and R4, and a corresponding rated voltage is output to the load terminal 20.

Figure 4:
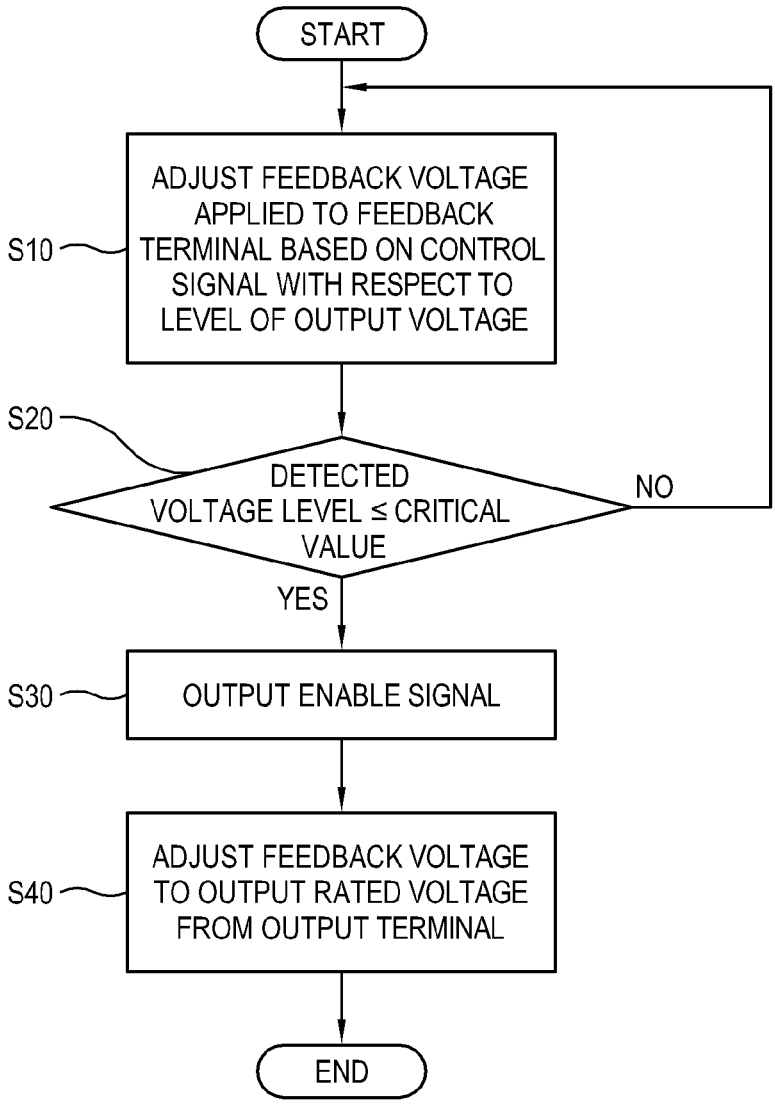
FIG. 4 is a control flowchart of a power control method of the electric device according to an exemplary embodiment of the present general inventive concept.

FIG. 4 is a control flowchart of a power control method of the electric device according to the exemplary embodiment of the present invention. The power control method by the microcomputer 51 will be described with reference to FIG. 4.

First, the feedback voltage $V_{F.B}$ which is applied to the feedback terminal F.B is adjusted on the basis of the control signal with respect to the level of the output voltage $V_{OUT}$ (S10). According to the level of the feedback voltage $V_{F.B}$, the constant voltage output unit 10 adjusts the level of the output voltage $V_{OUT}$ and outputs the output voltage $V_{OUT}$.

The detector 40 detects the level of the input voltage $V_{IN}$ of the load terminal 20, and determines whether the detected level of the input voltage $V_{IN}$ is the predetermined critical value or less (S20). The critical value may be lower than the lowest level of the output voltage $V_{OUT}$.

If it is determined that the detected level of the input voltage $V_{IN}$ is the critical value or less, the enable signal is output to the controller 50 (S30).

If the third switch FET3 is turned on by the enable signal, the feedback voltage $V_{F.B}$ is adjusted to output the rated voltage from the output terminal $V_O$ (S40). Then, the output voltage $V_{OUT}$ may be changed to the rated voltage immediately upon the occurrence of the drop of the input voltage $V_{IN}$ input to the load terminal 20.

Figure 5:
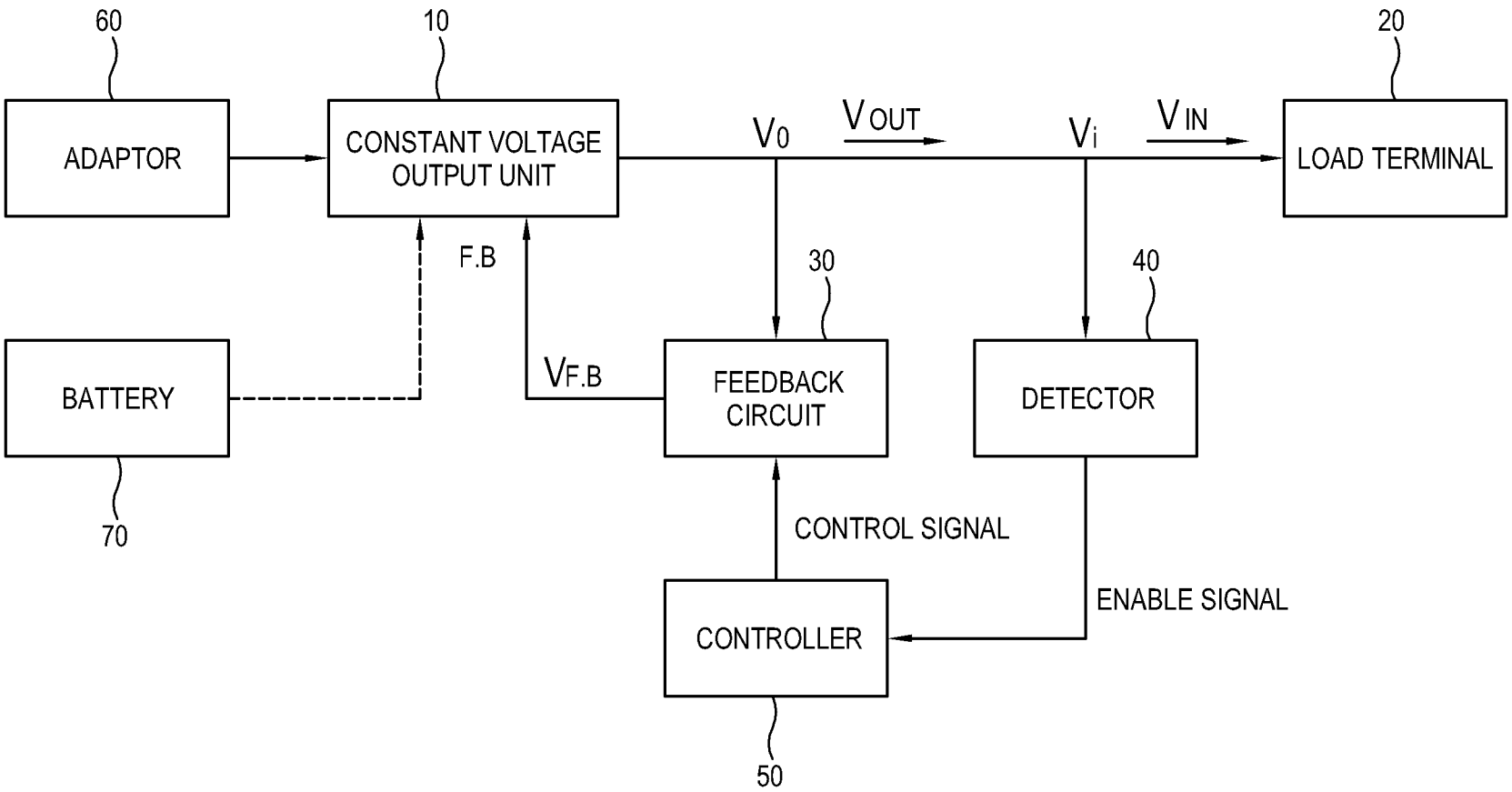
FIG. 5 is a control block diagram of an electric device according to an exemplary embodiment of the present general inventive concept.
Figure 6:
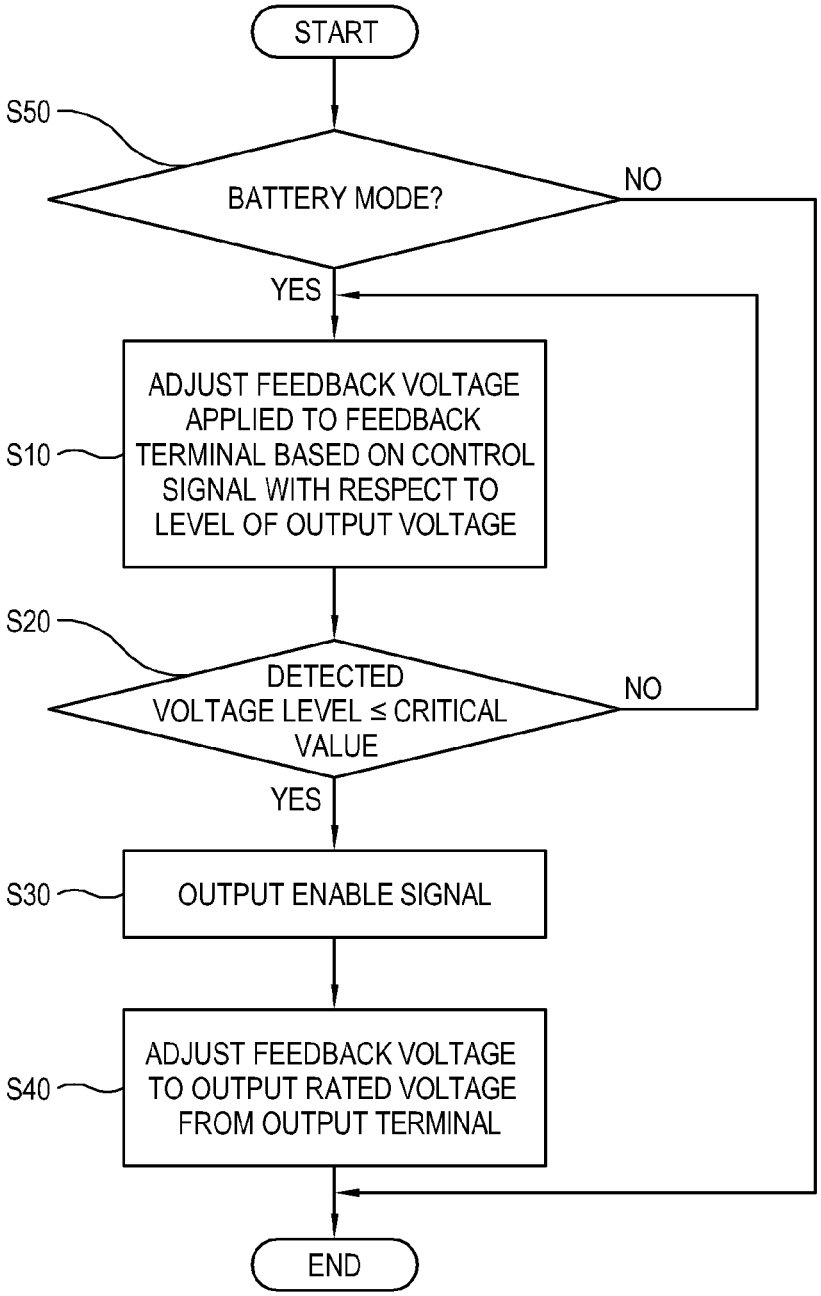
FIG. 6 is a control flowchart of a power control method of the electric device according to an exemplary embodiment of the present general inventive concept.

FIG. 5 is a control block diagram of an electric device according to another exemplary embodiment of the present invention. FIG. 6 is a control flowchart of a power control method of the electric device in FIG. 5.

As shown therein, the electric device further includes an adaptor 60 and a battery 70 which supply source power to a constant voltage output unit 10. Typically, a load terminal 20 of the electric device receives source power from the adaptor 60 if the adaptor 60 is connected to the electric device, and receives source power from the battery 70 if the adaptor 60 is not connected thereto. The former is defined an adaptor mode, and the latter is defined as a battery mode. In the battery mode, to secure the battery life, a voltage which is output from the constant voltage output unit 10 is lower than a rated voltage in the adaptor mode. That is, a performance of the load terminal 20 is adjusted to be lower and power consumption is reduced accordingly.

The controller 50 according to the present exemplary embodiment determines whether the load terminal 20 is driven in the battery mode as in FIG. 6 (S50). The battery mode may be set by a user's selection, or may automatically be set if the adaptor 60 is not connected to the electric device. If the battery mode is set, the feedback circuit 30 is controlled so that the output voltage $V_{OUT}$ becomes lower than the rated voltage as above.

If the electric device is driven in the battery mode, the controller 50 may enable the detector 40 and the OR circuit 53, and perform the control operation as above. That is, the controller 50 adjusts the feedback voltage $V_{F.B}$ applied to the feedback terminal F.B on the basis of the control signal as in FIG. 4 (S10), and the constant voltage output unit 10 adjusts the level of the output voltage $V_{OUT}$ according to the level of the feedback voltage $V_{F.B}$ and outputs the output voltage $V_{OUT}$.

The controller 50 then determines whether the detected level of the input voltage $V_{IN}$ is the predetermined critical value or less (S20), and controls the feedback circuit 30 to cause the constant voltage output unit 10 to output the rated voltage from the output terminal $V_O$ according to the enable signal if the detected level of the input voltage $V_{IN}$ is the critical value or less (S30 and S40).

Features of the present general inventive concept allow an electric device to be driven by less power to reduce power consumption, to detect input power of a load terminal to promptly and automatically respond to a sudden request for power from a load, and to supply a rated voltage corresponding to a detected level of the input power.

As described above, an electric device and a control method of the same according to an exemplary embodiment of the present invention efficiently changes a voltage to a rated voltage corresponding to a sudden change in a load terminal of a system that is intentionally driven by a voltage lower than the rated voltage to thereby supply stable power.

Also, an electric device and a control method of the same according to another exemplary embodiment of the present general inventive concept prevents a system error due to a sudden change in a load terminal.

Although a few exemplary embodiments have been shown and described, it will be appreciated by those skilled in the art that changes may be made in these exemplary embodiments without departing from the principles and spirit of the general inventive concept, the scope of which is defined in the claims and their equivalents.

What is claimed is:

1. An electric device comprising:

a constant voltage output unit including a feedback terminal to receive a feedback voltage and an output terminal to output an output voltage generated on the basis of the received feedback voltage and a predetermined reference voltage;

a feedback circuit connected between the output terminal and the feedback terminal to adjust the feedback voltage applied to the feedback terminal;

a load terminal to receive power from the constant voltage output unit;

a detector to output an enable signal when a voltage level of a power input terminal of the load terminal is a predetermined critical value or less; and a controller to receive the outputted enable signal and to control the feedback circuit to adjust the feedback voltage, wherein when the controller receives the outputted enable signal, the controller controls the feedback circuit to adjust the feedback voltage to cause the constant voltage output unit to output a rated voltage as the output voltage from the output terminal.

2. The electric device according to claim 1, wherein the predetermined critical value is lower than a lowest level of the output voltage required to drive the load terminal.

3. The electric device according to claim 1, wherein the feedback circuit comprises:

a first resistor connected between the output terminal and the feedback terminal;

a plurality of branch resistors, each branch resistor being disposed between a first node provided between the first resistor and the feedback terminal, and a ground terminal; and a switch connected in series to a first branch resistor of the plurality of branch resistors, between the first branch resistor and the ground terminal, such that a second branch resistor of the plurality of branch resistors is connected to the ground terminal without being connected in series with the switch, and the first branch resistor and the switch are connected in parallel with the second branch resistor; and the controller comprises:

a microcomputer to output a first control signal to control the feedback circuit to adjust the feedback voltage to cause the constant voltage output unit to output the rated voltage from the output terminal; and an OR circuit to receive one of the first control signal and the enable signal, and when one of the first control signal and the enable signal is received, to output a signal to the switch to turn on the switch.

4. The electric device according to claim 1, wherein the feedback circuit comprises:

a first resistor connected between the output terminal and the feedback terminal;

a plurality of branch resistors connected in series between a first node provided between the first resistor and the feedback terminal, and a ground terminal; and a switch individually connected between a node disposed between two of the plurality of branch resistors and the ground terminal; and the controller comprises:

a microcomputer to output a first control signal to control the feedback circuit to adjust the feedback voltage to cause the constant voltage output unit to output the rated voltage from the output terminal; and an OR circuit to receive one of the first control signal and the enable signal and when one of the first control signal and the enable signal is received, to output a signal to the switch to turn on the switch.

5. The electric device according to claim 1, further comprising an adaptor and a battery which supply source power to the constant voltage output unit, wherein the load terminal is driven by one of an adaptor mode in which the adaptor supplies the source power, and a battery mode in which the battery supplies the source power, and the controller controls the feedback circuit to adjust the feedback voltage to cause the constant voltage output unit to decrease the output voltage to be lower than the rated voltage if the load terminal is driven in the battery mode.

6. A control method of an electric device which comprises a constant voltage output unit including a feedback terminal to receive a feedback voltage and an output terminal to output an output voltage generated on the basis of the received feedback voltage and a predetermined reference voltage, and a load terminal to receive power from the constant voltage output unit, the control method comprising:

adjusting the feedback voltage applied to the feedback terminal on the basis of a control signal;

detecting a voltage level of a power input terminal of the load terminal and determining whether the detected voltage level is a predetermined critical value or less;

outputting an enable signal when the detected voltage level is the critical value or less; and adjusting the feedback voltage to cause the constant voltage output unit to output a rated voltage as the output voltage from the output terminal according to the enable signal.

7. The control method according to claim 6, wherein the critical value is lower than a lowest level of the output voltage required to drive the load terminal.

8. The control method according to claim 6, wherein the electric device comprises:

a first resistor connected between the output terminal and the feedback terminal;

a plurality of branch resistors, each branch resistor being disposed between a first node provided between the first resistor and the feedback terminal, and a ground terminal;

a feedback circuit which comprises a switch connected in series to a first branch resistor of the plurality of branch resistors, between the first branch resistor and the ground terminal, such that a second branch resistor of the plurality of branch resistors is connected to the ground terminal without being connected in series with the switch, and the first branch resistor and the switch are connected in parallel with the second branch resistor; and the control method further comprises outputting the enable signal to ensure the switch is turned on by a first control signal to cause the constant voltage output unit to output the rated voltage from the output terminal.

9. The control method according to claim 6, wherein the electric device comprises:

a first resistor connected between the output terminal and the feedback terminal;

a plurality of branch resistors connected in series between a first node, provided between the first resistor and the feedback terminal, and a ground terminal;

a feedback circuit which comprises a plurality of switches such that each switch is individually connected between a corresponding node disposed between a corresponding two of the plurality of branch resistors and the ground terminal; and the control method further comprises outputting the enable signal to ensure at least one of the switches is turned on by a first control signal to cause the constant voltage output unit to output the rated voltage from the output terminal.

10. The control method according to claim 6, wherein the electric device further comprises an adaptor and a battery to supply source power to the constant voltage output unit, the control method further comprising:

determining whether the source power is supplied by one of the adaptor or the battery; and adjusting the feedback voltage to cause the constant voltage output unit to output a level of voltage lower than the rated voltage if it is determined that the source power is supplied by the battery.

11. An electric device comprising:

a load terminal;

a constant voltage output unit to generate an output voltage to the load terminal;

a feedback circuit having a plurality of feedback circuit elements to generate a feedback signal to the constant voltage output unit to adjust the output voltage;

a detector unit to detect the output voltage input to the load terminal and, when the detected output voltage is equal to or less than a predetermined critical level, output an enable signal; and a controller to set a power mode of the electric device and to generate a control signal according to the enable signal and the set power mode such that the control signal corresponds to one or more of the feedback circuit elements to adjust the feedback signal.

12. The electric device of claim 11, wherein the control signal comprises a plurality of sub-control signals to correspond to the respective feedback circuit elements.

13. The electric device of claim 12, wherein the controller selectively outputs one or more of the plurality of sub-control signals according to the set power mode and the enable signal.

14. The electric device of claim 11, wherein if the set power mode is a low power mode and the enable signal is off, the control signal interacts with at least one of the feedback circuit elements to adjust the feedback signal to adjust the output voltage to a level lower than a rated voltage, and if the set power mode is the low power mode and the enable signal is on, the control signal interacts with at least one of the feedback circuit elements to adjust the feedback signal to adjust the output voltage to the rated voltage.

15. The electric device of claim 11, wherein the feedback circuit generates the feedback signal as a proportion of the output voltage according to the control signal and the constant voltage output unit generates the output voltage according to the proportion.

16. The electric device of claim 15, wherein the constant voltage output unit increases the output voltage when the proportion of the feedback signal and the output voltage increases and decreases the output voltage when the proportion of the feedback signal and the output voltage decreases.

17. An electric device comprising:

a constant voltage output unit to output an output voltage or a rated voltage from an output terminal thereof to a load terminal to provide an input voltage to the load terminal;

a feedback circuit unit to generate a feedback voltage as a proportion of the output voltage and transmit the feedback voltage to a feedback terminal of the constant voltage output unit to increase the output voltage when a proportion of the feedback voltage and the output voltage is increased and to decrease the output voltage when the proportion of the feedback voltage and the output voltage is decreased;

a detector unit to detect the input voltage of the load terminal and, when the detected input voltage is equal to or less than a predetermined critical value, output an enable signal; and a controller to control the feedback circuit unit to adjust the feedback voltage to cause the constant voltage output unit to output the rated voltage from the output terminal instead of the output voltage when the enable signal is received from the detector unit.

* * * * *